US011090524B2

(12) United States Patent
Brockway, Jr. et al.

(10) Patent No.: US 11,090,524 B2
(45) Date of Patent: Aug. 17, 2021

(54) INTEGRATED FABRIC SYSTEM FOR APPAREL

(71) Applicant: BROLT, LLC, Birmingham, AL (US)

(72) Inventors: Donald H. Brockway, Jr., Birmingham, AL (US); Steven Holt, Birmingham, AL (US); Alan Holt, Birmingham, AL (US)

(73) Assignee: BROLT, LLC, Birmingham, AL (US)

( * ) Notice: Subject to any disclaimer, the term of this patent is extended or adjusted under 35 U.S.C. 154(b) by 0 days.

(21) Appl. No.: 15/788,259

(22) Filed: Oct. 19, 2017

(65) Prior Publication Data

US 2018/0111016 A1 Apr. 26, 2018

Related U.S. Application Data

(60) Provisional application No. 62/411,207, filed on Oct. 21, 2016.

(51) Int. Cl.
*A63B 21/00* (2006.01)
*A63B 21/06* (2006.01)
(Continued)

(52) U.S. Cl.
CPC ..... *A63B 21/4025* (2015.10); *A41D 13/0015* (2013.01); *A41D 31/18* (2019.02);
(Continued)

(58) Field of Classification Search
CPC ..... A63B 21/4025; A63B 21/065; A63B 21/4001; A63B 21/4005; A63B 21/4007;
(Continued)

(56) References Cited

U.S. PATENT DOCUMENTS 1,919,292 A * 7/1933 Field ..... A41C 1/02 139/421
5,048,125 A * 9/1991 Libertini ..... A63B 21/065 2/79

(Continued)

OTHER PUBLICATIONS

International Search Report and Written Opinion from International Application No. PCT/US2017/057371 dated Jan. 4, 2018.

*Primary Examiner* — Joshua Lee
(74) *Attorney, Agent, or Firm* — Blank Rome LLP

(57) ABSTRACT

An article of apparel including an integrated fabric system, with or without strategically-placed weighting and/or elastic resistant materials, which optimizes conditioning, strengthening, endurance, enhancement, training, performance, functional longevity, benefits of daily activity, movement therapy, and/or other diverse medical and/or therapeutic uses, and, all while reducing the possibility of injury. The article enables the user to receive medical and/or therapeutic benefits and to increase production of kinetic energy, through weighted and/or elastic resistance, as required by the user's particularized needs. The user may benefit from the medical/therapeutic properties during periods of activity or inactivity. Benefits are achieved through the integration of fabrics and strategically-placed weighting and/or elastic resistance materials into the article based upon the kinetic energy created, necessitated, and/or dissipated by a specific movement(s) and/or medical or therapeutic requirements.

18 Claims, 8 Drawing Sheets

(51) Int. Cl.

| | |
|---|---|
| ***A63B 21/065*** | (2006.01) |
| ***A63B 21/04*** | (2006.01) |
| ***A63B 21/045*** | (2006.01) |
| ***A41D 13/00*** | (2006.01) |
| ***A63B 21/055*** | (2006.01) |
| ***A41D 31/18*** | (2019.01) |
| *A41D 31/30* | (2019.01) |

(52) U.S. Cl.
CPC ..... *A63B 21/0004* (2013.01); *A63B 21/045* (2013.01); *A63B 21/0407* (2013.01); *A63B 21/055* (2013.01); *A63B 21/0603* (2013.01); *A63B 21/065* (2013.01); *A63B 21/4007* (2015.10); *A41D 31/30* (2019.02); *A41D 2400/32* (2013.01); *A41D 2400/38* (2013.01); *A41D 2400/42* (2013.01); *A41D 2400/44* (2013.01); *A41D 2400/70* (2013.01); *A41D 2600/10* (2013.01); *A63B 2209/00* (2013.01)

(58) Field of Classification Search
CPC ..... A63B 21/4009; A63B 21/4011; A63B 21/4017; A63B 21/0004; A63B 21/0407; A63B 21/045; A63B 21/055; A63B 21/0603; A63B 2209/00; A41D 13/0015; A41D 31/30; A41D 2400/32; A41D 2400/38; A41D 2400/42; A41D 2400/44; A41D 2400/70; A41D 2600/10
See application file for complete search history.

(56) References Cited

U.S. PATENT DOCUMENTS

| | | | | |
|---|---|---|---|---|
| 5,555,562 | A | 9/1996 | Holt et al. | |
| 5,606,745 | A * | 3/1997 | Gray | A41D 13/0015 2/227 |
| 5,659,898 | A * | 8/1997 | Bell, Jr. | A41D 13/0015 2/115 |
| 5,784,716 | A | 7/1998 | Holt et al. | |
| 6,047,405 | A * | 4/2000 | Wilkinson | A41D 13/0015 2/115 |
| 6,209,135 | B1 | 4/2001 | Irvin | |
| 8,273,001 | B2 * | 9/2012 | Karecki | A63B 21/4025 2/22 |
| 9,095,177 | B2 * | 8/2015 | Ota | A41D 13/0015 |
| 9,327,156 | B2 * | 5/2016 | von Hoffmann | A63B 21/02 |
| 10,045,572 | B2 * | 8/2018 | Bratcher | A41D 13/0015 |
| 2001/0029224 | A1 | 10/2001 | Karecki | |
| 2004/0221355 | A1 * | 11/2004 | Garcia | A41D 7/00 2/67 |
| 2004/0260224 | A1 | 12/2004 | Binder et al. | |
| 2007/0271668 | A1 | 11/2007 | Pape | |
| 2009/0139005 | A1 | 6/2009 | Whaley | |
| 2010/0144490 | A1 * | 6/2010 | Purdy | A63B 21/0004 482/1 |
| 2011/0237995 | A1 * | 9/2011 | Ota | A63B 21/4011 602/75 |
| 2012/0094811 | A1 * | 4/2012 | Karecki | A63B 21/4011 482/121 |
| 2012/0102613 | A1 | 5/2012 | Loth et al. | |
| 2013/0298301 | A1 * | 11/2013 | Petrakis | A63B 21/065 2/69 |
| 2014/0148741 | A1 | 5/2014 | Moran | |
| 2014/0200121 | A1 * | 7/2014 | von Hoffmann | A63B 21/02 482/124 |
| 2014/0230124 | A1 * | 8/2014 | Wilms-Otto | A41D 13/0015 2/69 |
| 2014/0302970 | A1 * | 10/2014 | Sinclair | A63B 21/065 482/105 |
| 2015/0306441 | A1 * | 10/2015 | Yao | A63B 21/4019 482/124 |
| 2017/0036054 | A1 * | 2/2017 | Crume | B32B 1/00 |

* cited by examiner

INTEGRATED FABRIC SYSTEM FOR APPAREL

This application claims priority to U.S. Provisional Patent Application No. 62/411,207, filed Oct. 21, 2016. The entire disclosure of U.S. Provisional Patent Application No. 62/411,207 is incorporated herein by reference.

BACKGROUND OF DISCLOSURE

1. Field of Disclosure

This disclosure relates to an integrated fabric system for use in connection with, or during, exercise, training, conditioning, sport performance, movement therapy, rehabilitation, and/or human kinetic activities. According to one aspect of this disclosure, the system may be formed of diverse, stretchable, breathable, and wicking fabric(s). According to another aspect of this disclosure, the system may be formed, at least in part, of other flexible material(s) being integrated into and with, the diverse, stretchable, breathable, and wicking fabric(s). According to another aspect of this disclosure, a plurality of weighted and/or elastic resistance elements may be individually connected to or integrated into the fabric(s) or other flexible material(s). According to another aspect of this disclosure, an integrated fabric system is configured to be worn on, cover, wrap around, or at least partially surround, at least a portion of a human body in connection with, or during, exercise, training, conditioning, sport performance, movement therapy, rehabilitation, and/or human kinetic activities.

This disclosure also relates to an integrated fabric system for use in connection with, or during, exercise, training, conditioning, sport performance, normal daily activity, movement therapy, other diverse medical and/or therapeutic uses during periods of activity, inactivity, and/or rest as warranted by the requirements of the treatment and/or therapy, rehabilitation, and/or human kinetic activities. During periods of inactivity and/or rest, the user may experience medical and/or therapeutic benefits, even though the integrated fabric system is static (not moving). In other words, the integrated fabric system may provide static covering.

According to one aspect of this disclosure, the system may be formed of diverse, breathable, antimicrobial, graduated compression, and wicking fabric(s). According to another aspect of this disclosure, the system may be formed, at least in part, of other flexible material(s) being integrated into and with the diverse, breathable, antimicrobial, graduated compression, and wicking fabric(s). According to another aspect of this disclosure, a plurality of weighted and/or elastic resistance elements may be individually connected to or integrated into the fabric(s) or other flexible material(s). According to another aspect of this disclosure, an integrated fabric system is configured to be worn on, cover, wrap around, or at least partially surround, at least a portion of a human body in connection with, or during, exercise, training, conditioning, sport performance, normal daily activity, movement therapy, other diverse medical and/or therapeutic uses during periods of activity, inactivity, and/or rest as warranted by the requirements of the treatment and/or therapy, rehabilitation, and/or human kinetic activities.

2. Description of Related Art

It is known to apply weights to an athlete in training to improve the athlete's muscle strength and cardiovascular condition. Examples of known systems include ankle and wrist weights. As explained in U.S. Pat. No. 5,784,716 (Holt et al.), issued Jul. 28, 1998, the known ankle and wrist weights are unsatisfactory because they place excessive stress on articulates and over time may cause minor ligament tears, thus causing the articulates to become less stable and functional. The term "articulates" is used herein to mean the joints and jointed segments of the human body. The entire disclosure of U.S. Pat. No. 5,784,716 is incorporated herein by reference.

Another problem with the known systems is that they shift position during use. The conventional weights cannot be maintained in a desired position with respect to the wrists and ankles. The problem is aggravated by the fact that conventional weights are filled with shiftable particulate material and/or liquid. Shifting of the known systems during use imparts excessive joint forces that, over time, can damage tendons, ligaments, and other tissues surrounding and comprising body articulates.

Moreover, conventional weights are not supported except by the articulates being exercised. All of the inertial forces created by such weights must be resisted, dissipated, or facilitated through the joints themselves. For example, when a wrist weight is worn during a throwing motion, a large inertial force is applied to the elbow near the onset of the throwing motion and to the shoulder at the conclusion of the throwing motion, when the movement of the forearm is accelerated and decelerated, respectively. The inertial force of the weight applies an excessive force on both the shoulder and elbow in an uncontrolled manner. This inertial pulling effect places undue stress on the tendons, ligaments, and other tissues surrounding and comprising the upper extremity, causing the joints to lose their elasticity and functional stability over time. In general, a weight system that is concentrated far below the muscular insertion point of the respective joint, for example distal to the elbow near the wrist, will cause excessive strain of the tissues surrounding and/or comprising the joint cavity over time.

Training with shiftable and poorly distributed weights can also cause unbalanced muscle strength. For example, if wrist weights are used for a sports specific function involving rapid arm movements, the induced inertial forces about a joint may be too great to adequately train the smaller, stabilizing musculature of the shoulder. Consequently, larger muscles about the shoulder that traditionally function as prime movers of the joint begin to take on an additional stabilizing role in place of the smaller, traditionally stabilizing muscles. Therefore, overdevelopment of the larger shoulder muscles may occur rather than functional development of smaller, stabilizing rotator cuff and scapular muscles. Over time, this strength imbalance may cause diminished joint stability and functional integrity, muscle tightness in front of the shoulder in conjunction with muscle weakness on the back of the shoulder, and increasing discomfort in the anterior superior glenohumeral area. In general, conventional weight-training systems are poorly distributed, shiftable, subject to undesired inertial effects, unnecessarily complicated, inconvenient to use, and/or too expensive to manufacture.

The inventions described in U.S. Pat. No. 5,784,716 (Holt et al.) overcome many of the deficiencies and disadvantages of the prior art, but still have various disadvantages and deficiencies. Among other things, long, one-dimensional weights cannot be applied effectively to the human body's three-dimensional musculoskeletal structure. In a one-dimensional weight system, it is necessary to extend weight across regions of the body for mechanical reasons that are unrelated to the functional dynamic training that is desired.

In addition, while sometimes effective in increasing the resistance to an initiated motion, such as starting a forward throw, the one-dimensional weights tend to undesirably increase the inertial force that has to be placed on the body to stop the motion, because, among other reasons, they tend to slip within the pockets within which they are located. Locating weights in pockets is disadvantageous because the weights tend to slip in the axial direction of the pocket, such that the weight moves relative to the pocket during the motion and becomes displaced from the desired position.

Locating one-dimensional weights around a person's limb (arm or leg), not just along one side of the limb, would make the article difficult to put on and take off. In addition, a one-dimensional weight provides resilient, bending resistance to motion in a direction that is orthogonal to the long axis of the weight, but does not provide such resilient, bending resistance to motion that is parallel to its long axis. Furthermore, known systems tend to place one-dimensional weights directly over large muscle bellies with a goal of conditioning the musculature. This placement proves problematic, as it requires additional support of the weight from smaller, synergistic muscles while ineffectively targeting the desired gross musculature. As a result, the weight tends to disadvantageously distort the natural motions of the body part that is being exercised.

United States Pre-Grant Publication No. 2015/0306441 refers to an exercise garment that is formed of a base material and resistance bands. The base material is said to be formed of a moisture-wicking, stretchable material, such as for providing a compression fit. The resistance bands are said to be made of vulcanized silicone or rubber, and are said to have an elastic modulus substantially higher than that of the base material. The relative weight of the bands is not discussed in the document. According to the '441 publication, the bands may be "permanently fused" to the garment, or they can be detached and reattached. The bands may comprise sections of the garment that are integrated, such as by sewing, gluing, sonic welding, or the like, with the base material 100.

The '441 publication also refers to an "affixation system" to hold the resistance bands in place. The system is unnecessary to the present invention and is problematic. The "finger trap" mechanism mentioned in the '441 publication would constrict around the extremity when longitudinal force is applied to it which could create excessive constriction of the extremity and an uncomfortable sensation to the user.

A problem with resistance bands of the type mentioned in the '441 publication is that the amount of resistance created by such a band changes as a function of the band's length. In general, the longer the band is stretched, the more resistance is created. This could be problematic for the user because when a joint is moved to its end range of motion, thus fully stretching the resistance band, the associated musculature is in a suboptimal position for force generation.

Another problem with the system referred to in the '441 publication is that the configuration and locations of the resistance bands would not stress the musculature throughout the full range of joint motion. Considering, for example, flexion and extension at the hip, if the bands were tuned to provide no resistance in a neutral joint position, then hip flexion would stretch the band on the posterior side of the hip while the band on the anterior side scrunches up. Upon moving the hip back to neutral, the band on the posterior hip could actually assist in the movement, and no resistance would be applied to the hip until it crosses neutral and begins to move into extension.

Yet another problem with the system referred to in the '441 publication is that the resistance bands are placed inside channels or pockets or sandwiched between layers of fabric. The arrangement adds unnecessary complexity, and there are also other problems and disadvantages associated with the system referred to in the '441 publication.

SUMMARY OF DISCLOSURE

The present invention overcomes many of the disadvantages and deficiencies of the prior art, including many of the disadvantages and deficiencies of the systems described in U.S. Pat. No. 5,784,716 and United States Pre-Grant Publication No. 2015/0306441, by providing, among other things, an apparatus, which may be an article of clothing or apparel, that may be functionally applied to the body (or to one or more portions of the body) through the integration of fabrics and/or strategically-placed weighting and/or elastic-resistance materials; the combination of which may be designed to provide medical and/or therapeutic benefits during periods of rest, therapeutic activity and/or inactivity, help with weight loss and other general health benefits during normal daily activities, optimize exercise, training, rehabilitation, movement therapy, sport performance, human kinetic activities, conditioning, strengthening, endurance enhancement, balance, neuromuscular coordination, functional longevity, and improved activities of daily living; and, all while reducing the possibility of injury.

According to one aspect of this disclosure, a strategically-placed and/or a body-mapped, weighted, and elastic-resistance article of clothing/apparel may be non-shifting, form-fitting, flexible, stretchable, compression graduated, antimicrobial, wicking, and breathable. The article of clothing/apparel may include, if desired, one or more fabric substrates, one or more fabric substrates integrated with medical grade silicone, rubber, and/or one or more gel substances, one or more fabric substrates integrated with medical grade silicone, rubber, and/or one or more gel substances infiltrated with heavy particles, powdered elements, and/or minerals or metals, such as, but not limited to tungsten. The one or more fabrics, weighting, and elastic-resistance elements are strategically arranged to resemble and simulate the body's natural musculoskeletal system.

According to another aspect of this disclosure, elements may be strategically placed in or on a fabric material based upon medical and/or therapeutic requirements. The elements may be formed, for example, of silicone material. The fabric material may be, for example, a portion of a shirt or other article of apparel. The medical and/or therapeutic requirements may be, for example, a need or desire to reduce the size of a scar, improve the appearance of a scar, or prevent a scar from forming. The scar may be caused, for example, by trauma, surgery, or burning. The strategic placement may cause, for example, the silicone material to come into contact with the scar, or a location where the scar might otherwise form, when the shirt or apparel article is worn by a patient. In operation, if desired, an article of apparel may be formed according to the following steps: first, identify a need for a medical therapeutic benefit (such as, for example, scar treatment or avoidance, particularized to one or more patients), then, second, determine a strategic location (for example, on or in a fabric material or article of apparel) based on a predetermined correlation between the benefit and the location, and then, third, position one or more elements, such as, for example, a flat element of silicone material, at the strategic location, and then, fourth, cause the one or elements to be positioned on the one or more patients to achieve the desired benefits. The flat element of silicone material may be, if desired, integrated into the fabric material so that the flat element faces inwardly toward a patient when the article of apparel is worn by the patient.

Where desired, the specific material or materials of the article of clothing/apparel, and the distribution and/or placement of weight and/or elastic-resistance material in the article of clothing/apparel are strategically located to (1) provide the user with the means to increase his/her production of kinetic energy, through weighted and elastic resistance, as may be required by the user to successfully perform the skill/motion, thereby strengthening and conditioning the associated musculature performance that may be subsequently performed without the article of clothing/apparel and/or (2) train and improve the generation, transmission, and dissipation of kinetic energy, as would naturally occur during any given body movement.

According to one aspect of this disclosure, remarkable advantages may be obtained from the combined effect of strategically placed fabrics, with and/or without weighted and/or elastic resistance material, which are integrated into the article of clothing/apparel based upon the kinetic energy necessitated, generated, transmitted, and/or dissipated by one or more specific body movements. According to another aspect of this disclosure, a system that operates as an integrated whole with the user provides a unique ability to condition and train one or more facets of the musculoskeletal system, during the actual performance of the movement or movements required for a specific desired activity.

According to another aspect of this disclosure, remarkable advantages may be obtained from the combined effect of strategically placed fabrics, with and/or without weighted and/or elastic resistance material, which are integrated into the article of clothing/apparel based upon general body movement. According to another aspect of this disclosure, medical and/or therapeutic benefits may be obtained from the combined effect of strategically placed fabrics, with and/or without weighted and/or elastic resistance material, which are integrated into the article of clothing/apparel based upon medical and/or therapeutic requirements during periods of activity, inactivity, and/or rest. More specifically, during periods of inactivity and/or rest, medical and/or therapeutic benefits may be obtained, even though the integrated article of clothing/apparel is static (not moving on the user's body). According to another aspect of this disclosure, if desired for medical and/or therapeutic reasons, fabrics with strategically-placed therapeutic elements (e.g., sheets of molded silicone material), and with and/or without weighted and/or elastic resistance material, may be integrated into the article of clothing/apparel only in the inactive portion and/or by necessity may be integrated across an active and inactive portion as required for the desired benefit.

This disclosure describes an article of clothing/apparel that has at least one active portion and at least one inactive portion, fabric material for at least partially surrounding at least a portion of a wearer's body, and weighted and/or elastic resistance elements that are spaced apart from one another. The fabric material may extend across an entirety of the active portion and an entirety of the inactive portion, and the weighted and/or elastic resistance elements may form a pattern. If desired, the fabric material is covered by the pattern in the active portion, and the weighted elements are not located in the inactive portion, such that the inactive portion is more stretchable and foldable than the active portion. If desired, the weighted and/or elastic elements are integrated with the fabric material in the active portion, such that the active portion is heavier than the inactive portion. If desired, therapeutic elements are integrated with the fabric material in the inactive portion only.

This disclosure also relates to a method of putting on and wearing an article of clothing/apparel, which includes the steps of stretching a fabric material between weighted and/or elastic resistance elements, such that the weighted and/or elastic resistance elements move away from each other, and, subsequently, locating active and inactive portions of the article of clothing/apparel at desired locations on a person's body.

DETAILED DESCRIPTION OF ILLUSTRATIVE EMBODIMENTS

Figure 1:
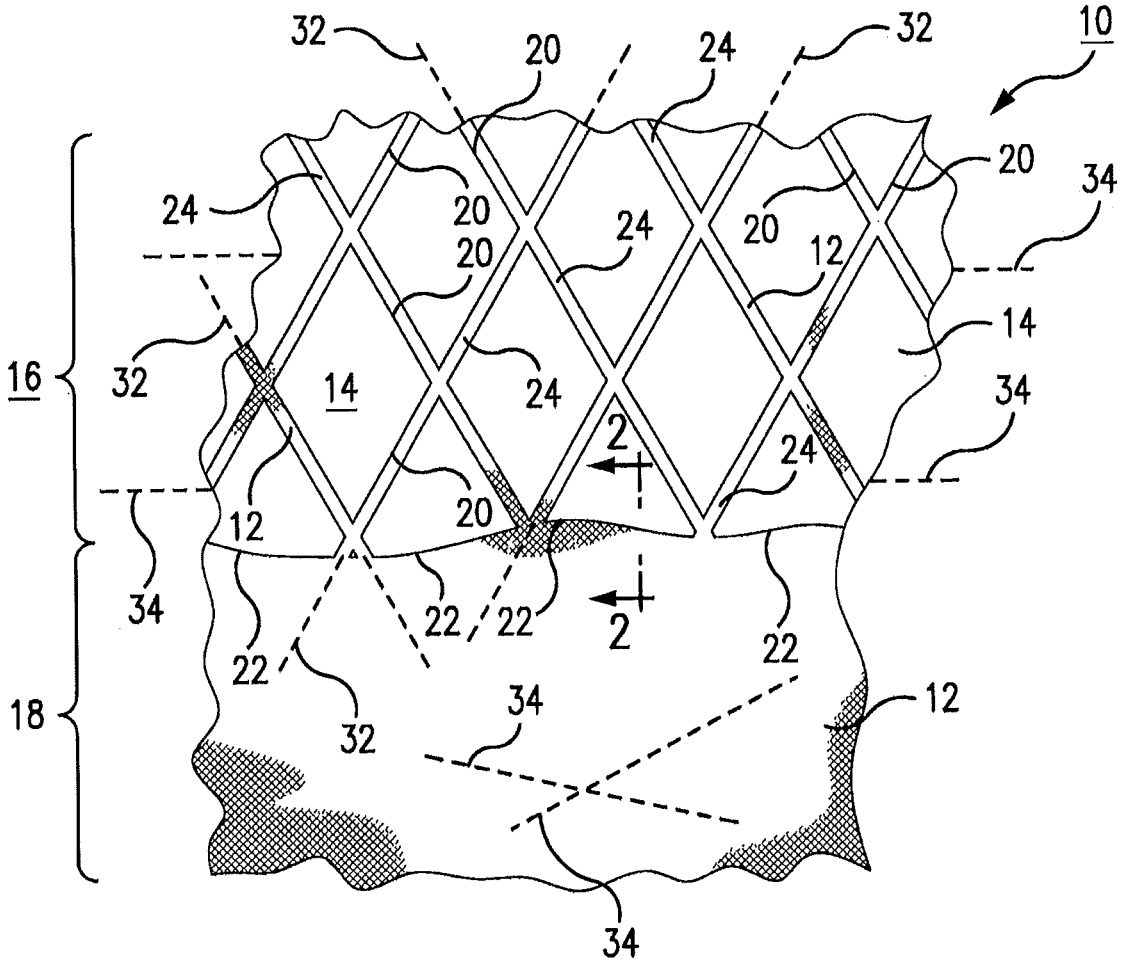
FIG. 1 is a plan view of a portion of an integrated fabric system constructed in accordance with a first embodiment of this disclosure.

Referring now to the drawings, where like reference numerals designate like elements, there is shown in FIG. 1 an integrated fabric system 10 that is constructed in accordance with one aspect of this disclosure. The integrated fabric system 10 includes cloth or other fabric material 12 and weighted and/or elastic resistance elements 14. The weighted and/or elastic resistance elements 14 extend across an active portion 16 of the integrated fabric system 10. The weighted and/or elastic resistance elements 14 are not located on an inactive portion 18 of the system 10. Most of the weighted and/or elastic resistance elements 14 have a diamond shape in the plan view of FIG. 1, with four sides 20. However, the diamond shape is but an example of the various shapes that may be used for diverse purposes. Some of the weighted and/or elastic resistance elements 14 have truncated-diamond shapes in the plan view of FIG. 1, with truncated edges 22 that are contiguous with a border of the inactive portion 18. The sides/edges 20, 22 of the weighted and/or elastic resistance elements 14 are spaced apart from each other by empty lanes 24. Again, the shapes shown in FIG. 1 are for purposes of illustration only, and ultimately various shapes for different strategic purposes may be integrated.

The fabric material 12 may be formed of any suitable material but is preferably formed of a soft, lightweight, comfortable, flexible, stretchable, breathable, and wicking material that provides sufficiently rugged and durable support. If desired, air and moisture may pass through the fabric material 12 in the vicinity of the empty lanes 24 and the inactive portion 18. According to an alternative aspect of this disclosure, the fabric material may be in the form of a flexible, stretchable open mesh.

The weighted and/or elastic resistance elements 14 may be formed of any suitable (preferably elastomeric) material but are preferably formed of a medical grade silicone, rubber, and/or one or more gel substances. The weighted and/or elastic resistance elements 14 may be impregnated, or otherwise provided, with a relatively heavy material 30 (FIG. 2), which may be in the form of particles, powdered elements, and/or minerals or metals, such as, but not limited to tungsten. The heavy material 30 is indicated schematically in FIG. 2.

The fabric material 12 may be much more flexible and pliable than the weighted and/or elastic resistance elements 14, such that the integrated fabric system 10 is (1) highly flexible and bendable around first axes 32 that extend through the empty lanes 24 and across the inactive portion 18 but (2) much less flexible and bendable around second axes 34 that do not extend through an empty lane 24 or across the inactive portion 18. The fabric material 12 should have sufficient resiliency, and should be worn tightly enough, to limit the movement of the weighted and/or elastic resistance elements 14 relative to an adjacent portion of the wearer's body, so that the weighted and/or elastic resistance elements 14 do not shift in any significant degree relative to the adjacent portion of the wearer's body during use. If desired, the integrated fabric system 10 may be sized relative to the wearer's body to be sufficiently tight that friction helps to maintain the weighted and/or elastic resistance elements 14 in desired positions, so as to avoid chafing of the wearer's skin, and so as to maintain the desired positions of the weighted and/or elastic resistance elements 14 for the desired effect.

On the other hand, the fabric material 12 should be sufficiently stretchable to permit the weighted and/or elastic resistance elements 14 to separate from each other so that a user can easily put the system 10 on, move around in it, and take it off. When the system 10 is being put on and taken off by the user, the fabric material 12 within an empty lane 24 may stretch to a sufficient extent in a direction that is perpendicular to the axis 32 of the empty lane 24, accompanied by some but substantially less stretching of the adjacent weighted and/or elastic resistance elements 14. And, when the system 10 is being put on and taken off by the user, the fabric material 12 within an empty lane 24 may bend (or fold) sufficiently around the empty lane axis 32, accompanied by some but substantially less bending of the adjacent weighted and/or elastic resistance elements 14. The fabric material 12 is generally stretchable and foldable. The weighted and/or elastic resistance elements 14 are somewhat stretchable and bendable, but less so than the fabric material 12.

Figure 2:
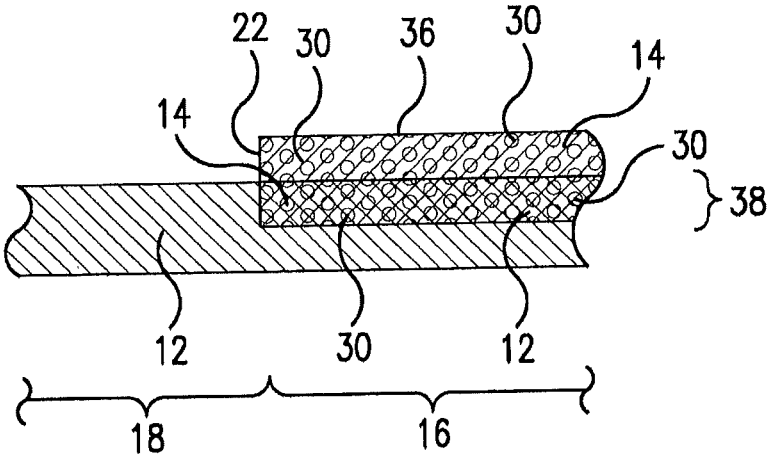
FIG. 2 is a cross-sectional view of the system portion of FIG. 1, taken along the line 2-2.

As shown in FIG. 2, each weighted and/or elastic resistance element 14 may be molded into the fabric material 12 so as to be integrated with the fabric material 12 and form a single integral piece with the fabric material 12. In other words, a molding process may create a layer 38 that contains material of the weighted and/or elastic resistance element 14 mixed into the interstices of the fabric material 12, so that the weighted and/or elastic resistance element 14 does not move relative to the portion of the fabric material 12 that is located directly beneath the weighted and/or elastic resistance element 14. The weighted and/or elastic resistance elements 14 preferably are not just glued to the surface of the fabric material 12 but become a part of the fabric material 12 through the molding process. In the preferred embodiment, the weighted and/or elastic elements 14 are integrated into and become one unitary piece with the fabric material 12, by entering into and residing within the interstices of the fabric material 12.

Each weighted and/or elastic resistance element 14 preferably has a flat upper surface 36. If desired, other fabric material and/or stitching (not illustrated) may be used to supplement the connections between the weighted and/or elastic resistance elements 14 and the fabric material 12.

Figure 3:
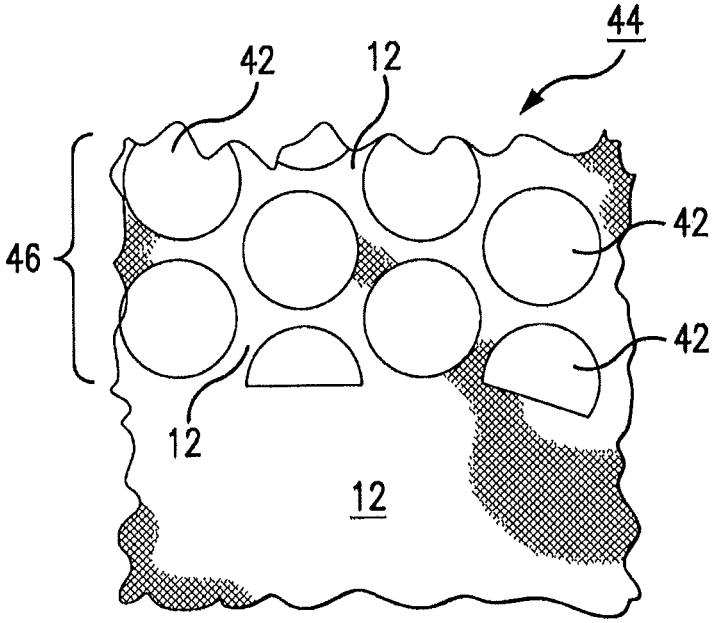
FIG. 3 is a plan view of an integrated fabric system portion with weighted and/or elastic resistance elements that are constructed in accordance with a second embodiment of this disclosure.

Turning now to FIG. 3, weighted and/or elastic resistance elements 42 may have a circular shape. The circular weighted and/or elastic resistance elements 42 are flat-topped and otherwise like the diamond-shaped weighted and/or elastic resistance elements of FIGS. 1 and 2, and may be integrated together with the fabric material 12 in essentially the same way as shown in FIG. 2. The pattern of the circular weighted and/or elastic resistance elements 42 shown in FIG. 3 provides more space between adjacent weighted and/or elastic resistance elements 42, and thereby increases the overall flexibility of the system 44 within its active region 46. The integrated fabric system 44 may be otherwise the same as the integrated fabric system 10 shown in FIGS. 1 and 2.

Figure 4:
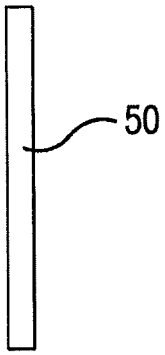
FIG. 4 is a plan view of a weighted and/or elastic resistance element that is constructed in accordance with yet another embodiment of this disclosure.
Figure 5:
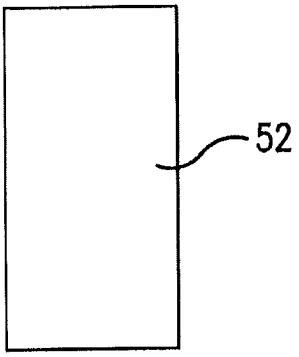
FIG. 5 is a plan view of a weighted and/or elastic resistance element that is constructed in accordance with yet another embodiment of this disclosure.

Additional shapes for weighted and/or elastic resistance elements 50, 52 are illustrated in FIGS. 4 and 5. The weighted and/or elastic resistance element 50 illustrated in FIG. 4 may have a thin rectangular (thin-banded) shape, while the weighted and/or elastic resistance element 52 illustrated in FIG. 5 may have a wide rectangular (wide-banded) shape. Weighted and/or elastic resistance elements of different shapes including but not limited to diamonds, circles, ovals, rectangles, triangles, squares, hexagons, and/or octagons may be employed together to create an integrated fabric system with any desired pattern that can be used to effectively map a portion of the human body in terms of strength, joint location, and desired flexibility, and/or may be strategically placed for medical and/or therapeutic benefit in the active and/or inactive portions(s). However, if all of the elements of a particular integrated fabric system have the same shape and are in a regular pattern, it may be more efficient to stencil and mold the weighted and/or elastic resistance elements onto the fabric material 12 during manufacturing.

The banded weighted and/or elastic resistance elements 50, 52 illustrated in FIGS. 4 and 5 may be employed, if desired, in a regular pattern. The illustrated elements 50, 52 are flat-topped and otherwise like the diamond-shaped weighted and/or elastic resistance elements of FIGS. 1 and 2, and may be integrated together with the fabric material 12 in essentially the same way as shown in FIG. 2. The pattern of the banded elements 50, 52, and the arrangement of spaces between the banded elements 50, 52, may be employed to provide different flexibilities in different, orthogonal directions within the active region. The integrated fabric system employing such banded elements 50, 52 may be otherwise the same as the integrated fabric system 10 shown in FIGS. 1 and 2.

Figures 6, 7:
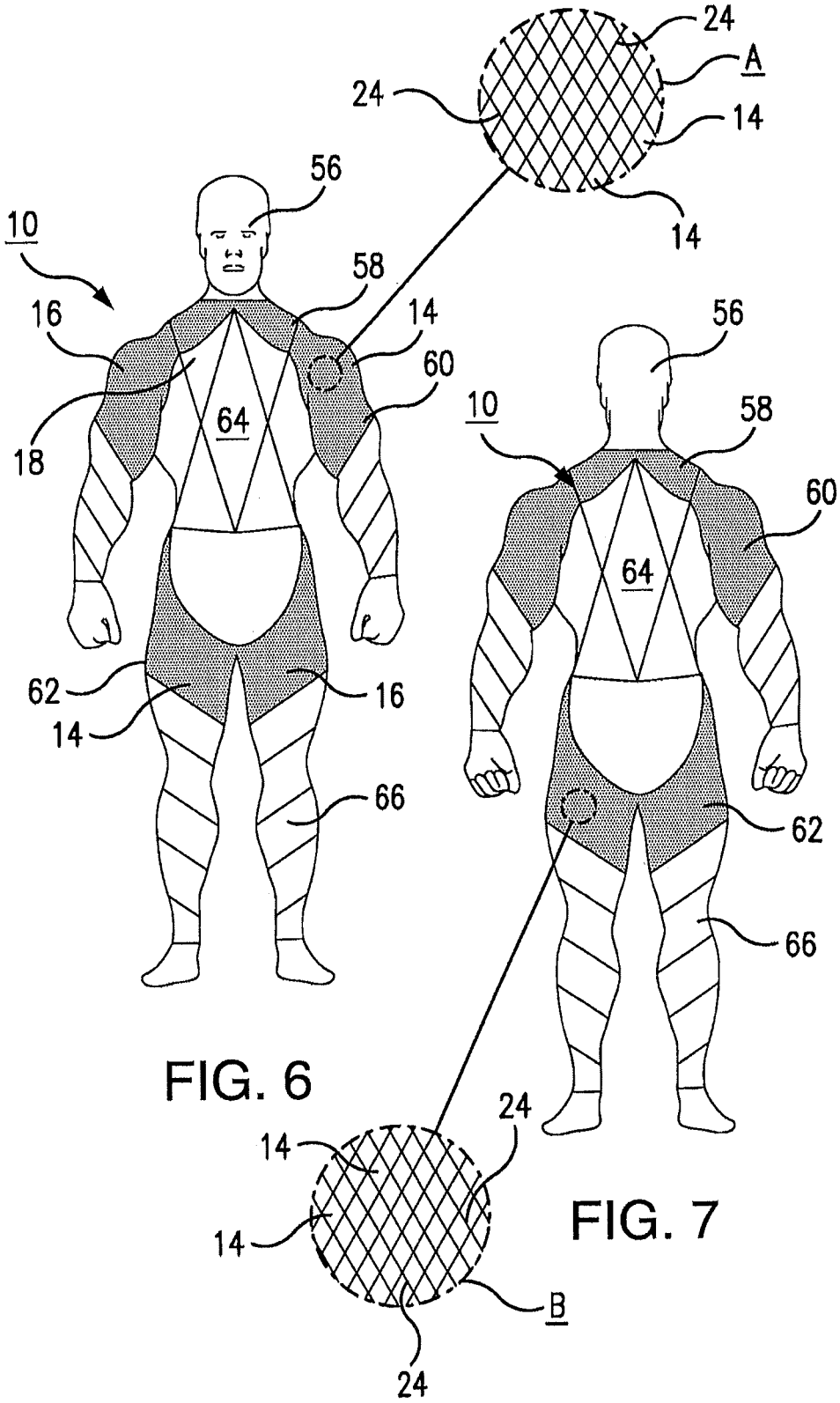
FIG. 6 is a front view of a person wearing an illustrative example of the integrated fabric system of FIGS. 1 and 2, where Circle A is an enlarged view of a portion of the system, and where all of the stippled portion of the system shown in FIG. 6 has the pattern shown in Circle A.
FIG. 7 is a rear view of the person of FIG. 6, where Circle B is an enlarged view of a portion of the system, and where all of the stippled portion of the system shown in FIG. 7 has the pattern shown in Circle B.

FIGS. 6 and 7 show a person 56 wearing an illustrative example of the integrated fabric system 10, with the weighted and/or elastic resistance elements 14 located over the shoulders 58, and wrapped around the upper arms 60 and upper thighs 62. The integrated fabric system 10 is incorporated into a tight-fitting, stretchable shirt 64 and stretchable tights 66 so that the weighted and/or elastic resistance elements 14 are held snugly in the illustrated positions, with the cloth or other fabric material 12 located between the weight and elastic elements 14 and the skin of the person 56.

Figures 8, 9:
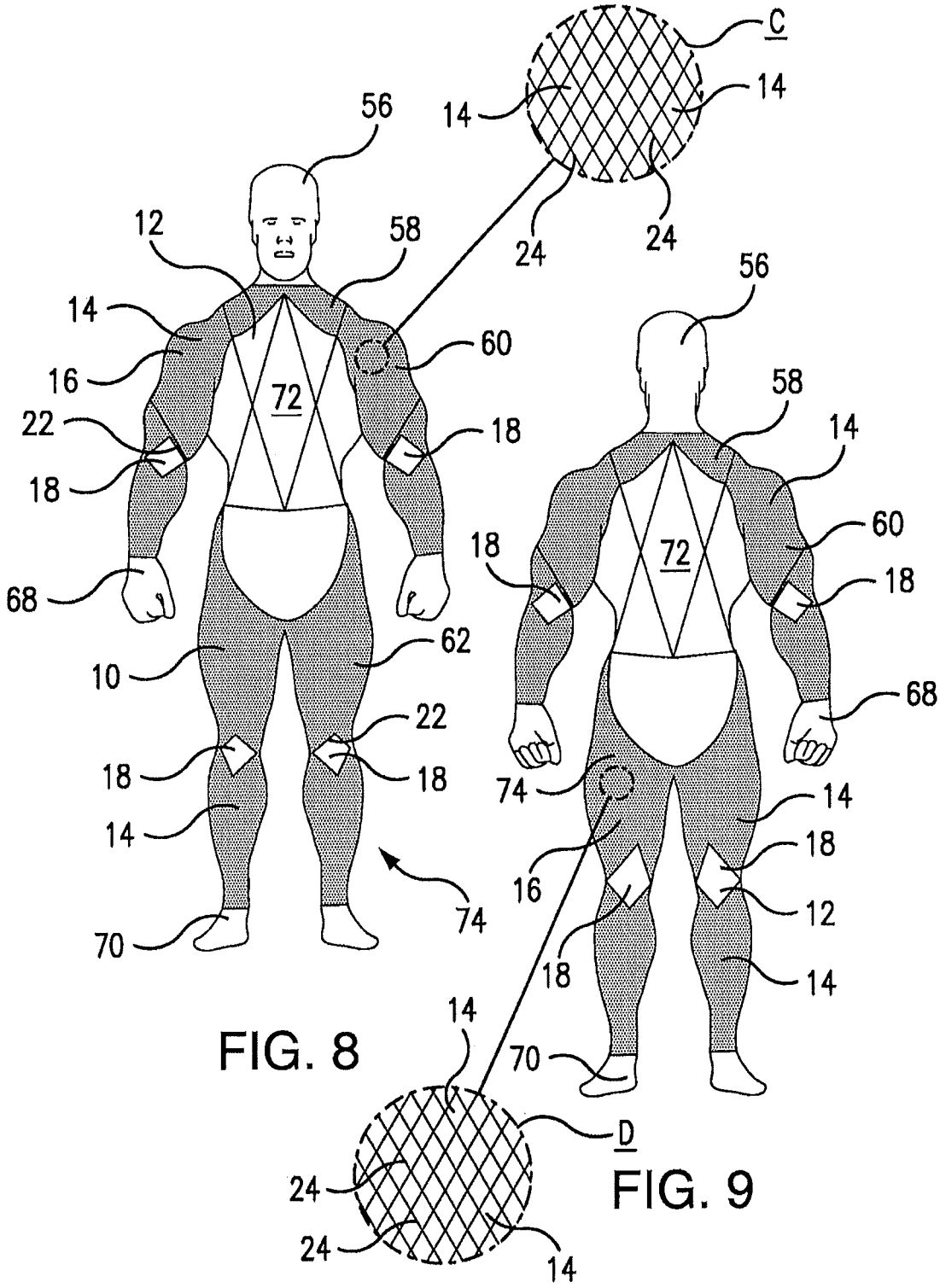
FIG. 8 is a front view of a person wearing an illustrative example of an integrated fabric system constructed in accordance with another embodiment of this disclosure, where Circle C is an enlarged view of a portion of the system, and where all of the stippled portion of the system shown in FIG. 8 has the pattern shown in Circle C.
FIG. 9 is a rear view of the person of FIG. 8, where Circle D is an enlarged view of a portion of the system, and where all of the stippled portion of the system shown in FIG. 9 has the pattern shown in Circle D.

FIGS. 8 and 9 show the person 56 wearing another illustrative example of an integrated fabric system, where the cloth or other fabric material 12 and the weighted and/or elastic resistance elements 14 extend from the upper arms 60 to the wrists 68, and from the upper thighs 62 to the ankles 70. Similarly to the system 10 shown in FIGS. 6 and 7, a tight-fitting, stretchable shirt 72 and tight-fitting stretchable tights 74 maintain the weighted and/or elastic elements 14 in the desired positions during use. Inactive portions 18, where there are no weighted and/or elastic resistance elements 14, are located in the vicinities of the elbows and knees, so as not to impede the basic functional mobility of the arms and legs of the wearer 56. In the embodiments shown in FIGS. 6-9, the stretchable fabric 12 within the empty lanes 24 (FIG. 1) of the pattern of weighted and/or elastic resistance elements 14 makes it possible for active portions 16 of the shirt 64, 72 and tights 66, 74 to be easily stretched and folded when the system 10 is put on and taken off by the person 56.

The cloth or other fabric material 12 may be constructed of a durable, lightweight, breathable, and wicking material made of elastomeric fibers, and is worn skin-tight. The tightness of the suit 10 may be used to physically support musculature of the arms, legs, and torso for attenuated muscle oscillation during dynamic activities, reduce microtrauma and musculature damage, improve joint awareness, mitigate swelling, and diminish perceived muscle soreness. In addition, the compression of the suit 10 may be used to alter local blood flow for improved venus return, accelerated metabolic waste removal from muscles, limitation of edema, as well as increased arterial pulse blood flow for improved oxygen delivery to working tissues. The skin-tight, stretchy, lightweight, breathable, and wicking material of the illustrated embodiment is particularly well suited for safe and effective conditioning regardless of environmental conditions.

Figures 10, 11:
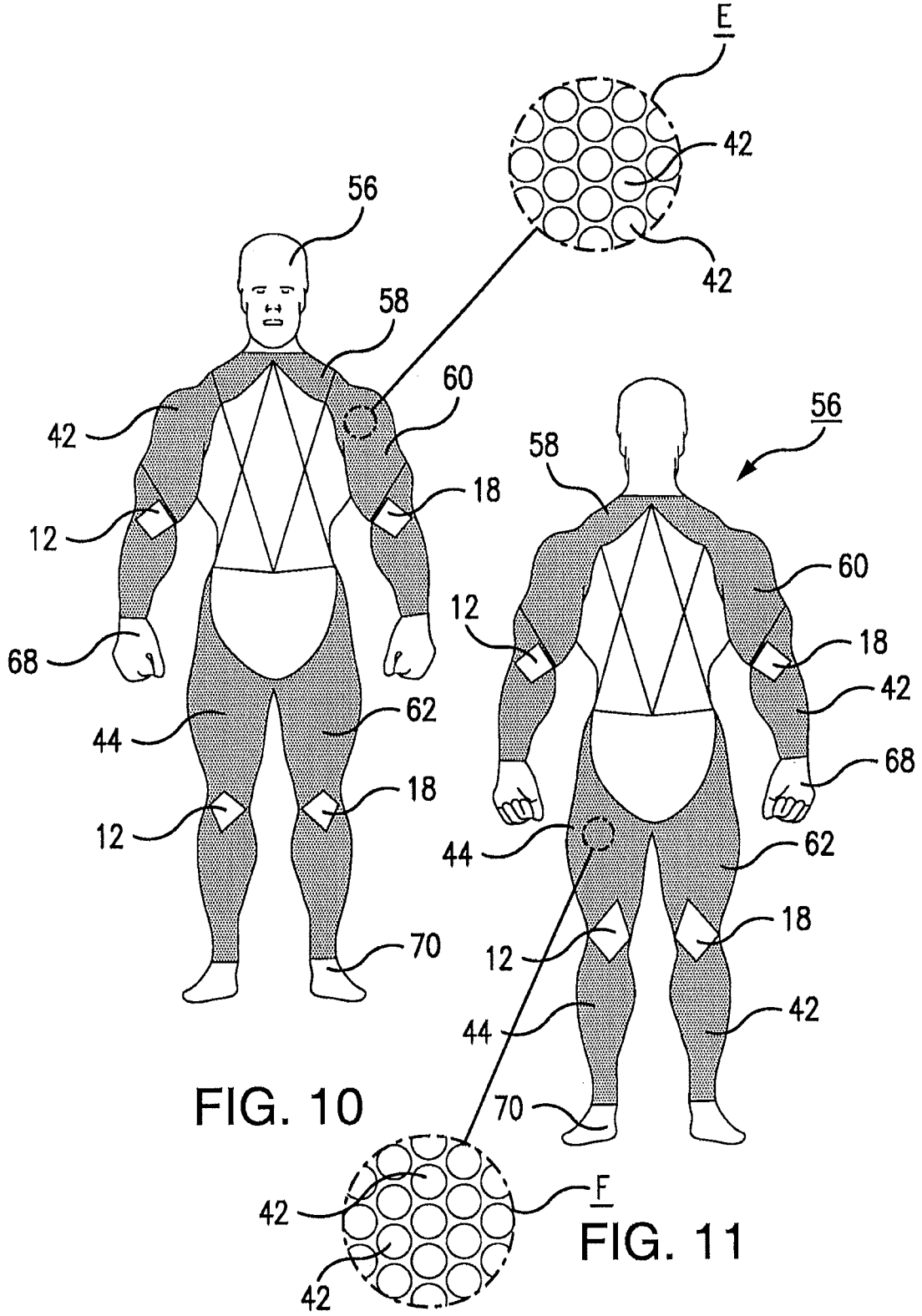
FIG. 10 is a front view of a person wearing an illustrative example of the integrated fabric system of FIG. 3, where Circle E is an enlarged view of a portion of the system, and where all of the stippled portion of the system shown in FIG. 10 has the pattern shown in Circle E.
FIG. 11 is a rear view of the person of FIG. 10, where Circle F is an enlarged view of a portion of the system, and where all of the stippled portion of the system shown in FIG. 11 has the pattern shown in Circle F.

The integrated fabric system illustrated in FIGS. 10 and 11 is essentially the same as the system shown in FIGS. 8 and 9, except that the FIGS. 10 and 11 system has the pattern of circular weighted and/or elastic resistance elements 42 shown in FIG. 3. As such, the system illustrated in FIGS. 10 and 11 may be more generally flexible and foldable within its active portions and thereby easier for the user 56 to put on and take off.

Figure 12:
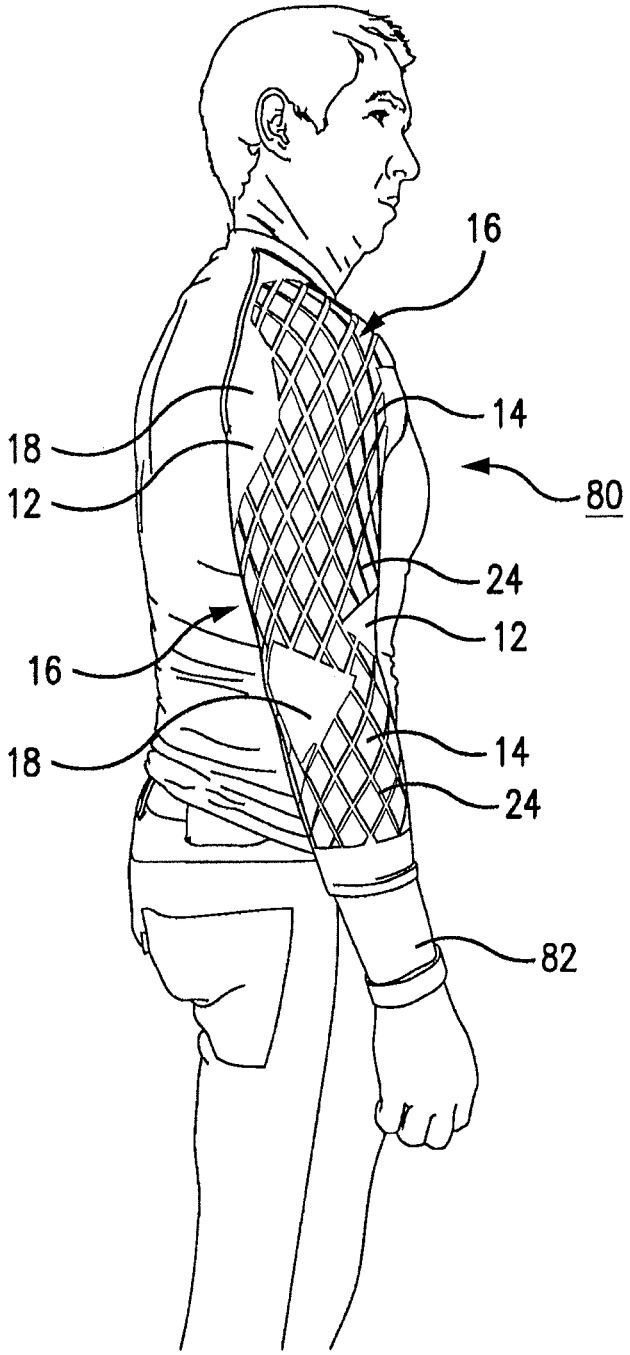
FIG. 12 is a right-side view of a person wearing an illustrative example of a stretchable shirt Constructed in accordance with an embodiment of this disclosure.
Figure 13:
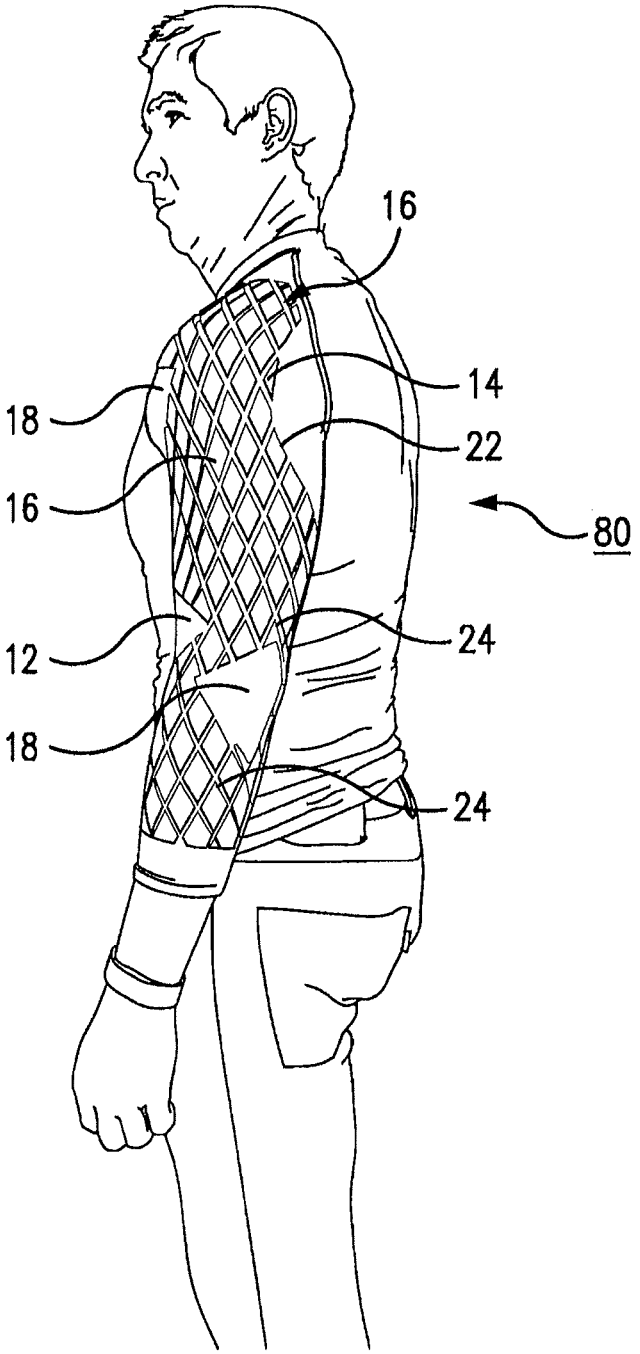
FIG. 13 is a left-side view of the person of FIG. 12.
Figure 14:
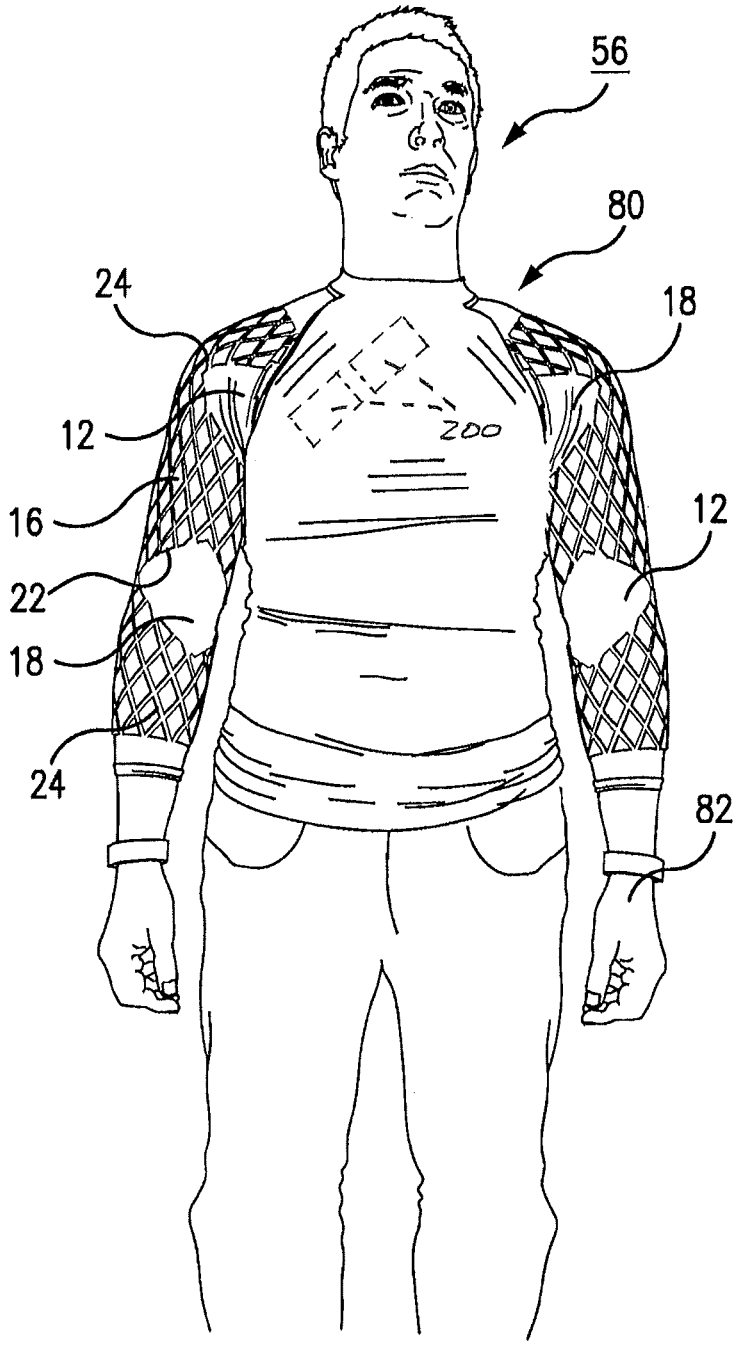
FIG. 14 is a front view of the person of FIG. 12. The stretchable shirt illustrated in FIG. 14 has an inwardlyfacing, integrated element which can be used, for example, to achieve a medical and/or therapeutic benefit.

As shown in FIGS. 12-14, a shirt 80 has active portions 16 located only above the shoulder, around the upper arm, around a portion of the lower arm, and connecting the upper and lower arms. Inactive portions 18 are located partially around and underneath the shoulder, in front of and behind the elbows, and above the wrist 82. Even though the shirt 80 fits the wearer 56 snugly, the fabric material 12 can stretch within the empty lanes 24 (FIG. 1) between the weighted and/or elastic resistance elements 14, which makes it easy to put the shirt 80 on and take it off. Moreover, the selective positioning of the active and inactive portions 16, 18 provides resilient inertial resistance to upper extremity motions, without adversely affecting normal musculoskeletal function.

Returning now to FIG. 1, this disclosure shows an article of movement-related clothing/apparel 10 that has active and inactive portions 16, 18. In operation, fabric material 12 surrounds a wearer's limb, and extends across the active and inactive portions 16, 18. Planar weighted and/or elastic resistance elements 14 are spaced apart (24) from each other, and form a regular, repeating array (or pattern). The fabric material 12 is covered by the pattern 14, 24 in the active portion 16, but the weight elements 14 are not located in the inactive portion 18. The inactive portion 18 may be made up of only the fabric material 12 and nothing else, however, the fabric material may vary for desired effects. Thus, the inactive portion 18 is more stretchable and foldable than, and not as heavy as, the active portion 16. The weighted and/or elastic resistance elements 14 are integrated with the fabric material 12 in the active portion 16. Direction-oriented elastic resistance may be created within the active portion 16 by using oriented elastic stitching and/or different types of fabrics.

To put the article of apparel 10 on, the wearer can stretch the fabric material 12 between the weighted and/or elastic resistance elements 14, such that the weighted and/or elastic resistance elements 14 move away from each other. After the active and inactive portions 16, 18 reach their desired locations on the wearer's limbs, the weighted and/or elastic resistance elements 14 move back toward each other as the fabric material 12 returns to the snug-fit condition shown in FIGS. 6-14. The process may be essentially reversed to remove the article 10 from the wearer.

Further, as illustrated in FIG. 14, therapeutic elements 200 are strategically located to, for example, cover a scar (not illustrated) (or, a location where a scar might otherwise form). In the illustrated embodiment, each element 200 is a sheet of silicone material and is integrated into the fabric of the shirt 80 in the manner illustrated in FIG. 2, but is positioned such that the silicone material element 200 faces a patient 56, and comes into contact with the skin of the patient 56. In operation, the elements 200 may satisfy medical and/or therapeutic requirements, such as, for example, a need or desire to reduce the size of the scar, improve the appearance of the scar, or prevent the scar from forming. The scar may be caused, for example, by trauma, surgery, or burning. In the illustrated embodiment, the strategic placement of the elements 200 causes the silicone material to come into contact with the scar, or a location where the scar might otherwise form, when the shirt 80 (or other article) is worn by the patient 56.

In operation, the article of apparel 80 may be formed according to the following steps: first, identify a need for a medical therapeutic benefit (such as, for example, scar treatment or avoidance, particularized to one or more patients 56), then, second, determine a strategic location (for example, on or in a fabric material or article of apparel 80) based on a predetermined correlation between the benefit and the location, and then, third, position one or more elements 200, such as, for example, a flat element of silicone material, at the strategic location, and then, fourth, put the article of apparel 80 on the patient 56 to cause the one or elements 200 to be positioned to achieve the desired benefits. The flat element 200 of silicone material may be integrated (e.g., molded) into the fabric material (as illustrated in FIG. 2) and located on the inside of the fabric material so that the flat element 200 faces inwardly toward the patient 56 when the article of apparel 80 is worn by the patient 56.

The following is a non-exhaustive list of important aspects and features associated with this disclosure. One or more of the following may be employed, if desired, to achieve advantages and/or overcome problems in the prior art:

(1) The use of elements 14 that are each weighted and elastic, where each element 14 operates as a single entity to provide the desired weight and elastic resistance.

(2) The utilization of various shapes and patterns (see, for example, FIGS. 1 and 3-5). If desired, weighted and/or elastic resistance elements of different shapes, and/or in different patterns, may be incorporated into a single article of apparel.

(3) Although the present invention is generally applicable to the general public, for use in connection with general exercise, the features described herein may be especially useful for elite, highly-trained athletes, especially when such athletes engage in very specific skills and movements. The invention may be used, for example, to promote higher performance, improve the athlete's generation, transmission, and dissipation of kinetic energy, and/or to condition the athlete in a safe manner. One of the reasons why the article of apparel 10 has such special capabilities is because it permits placement of the active and inactive portions 16, 18 in strategic locations. It should be understood, however, that the invention may have important advantages when used by average athletes and young athletes, and the invention may have important advantages when used for therapy and rehabilitation.

(4) In a preferred embodiment of the invention, the weighted silicone elements 14 are embedded into the interstices of the fabric (12) itself. In the preferred embodiment, such embedding of the weighted, elastic material into the interstices of the fabric 12, shown in FIG. 2, may provide advantages over gluing, sewing, and sonic welding.

This disclosure also provides, among other things, an apparatus that has at least one active portion, at least one inactive portion, and fabric material for at least partially surrounding at least a portion of a wearer's limb, pelvis, and/or torso, wherein the fabric material extends across an entirety of the active portion and an entirety of the inactive portion. The apparatus may also have resistance elements possessing both weighted and elastic properties that are spaced apart from each other, and which form a pattern, wherein the fabric material is covered by the pattern in the active portion, and wherein the weighted and/or elastic resistance elements are not located in the inactive portion, such that the inactive portion is more stretchable and foldable than the active portion. According to one aspect of this disclosure, the weighted and/or elastic resistance elements are integrated with the fabric material in the active portion, such that the active portion is heavier than the inactive portion.

Further, according to another aspect of this disclosure, the apparatus also has resistance elements possessing solely elastic resistance properties. The non-weighted, solely-elastic resistance elements may be separate from, and in addition to, resistance elements that are both weighted and elastic. The purely-elastic elements may be in the form of various elastic fabrics (e.g., a fabric that is more stretch resistant than the fabric material 12) and/or fabric stitching methods. For example, one or more solely-elastic elements may be incorporated into or added to the fabric material 12 at the back of the elbow, while no resistance elements are located at the front of the elbow. The back of the elbow could then be considered an active portion relative to the inactive portion at the front of the elbow. According to a preferred embodiment, the various elastic fabrics and/or stitching are integrated with the fabric 12 in one or more active portion(s).

This disclosure also provides a method of putting on an article of motion-related clothing/apparel. The method includes the steps of providing the motion-related clothing/apparel with (1) fabric material and (2) weighted and/or elastic resistance elements that are spaced apart from each other, and which form a pattern, wherein the fabric material is covered by the pattern in an active portion, and wherein the weighted and/or elastic resistance elements are not located in an inactive portion, such that the inactive portion is more stretchable and foldable than the active portion, and wherein the weighted and/or elastic resistance elements are integrated with the fabric material in the active portion, such that the active portion is heavier than the inactive portion. In operation, the fabric material is stretched between the weighted and/or elastic resistance elements, such that the weighted and/or elastic resistance elements move away from each other and, subsequently, the active and inactive portions are located and secured at desired locations on a wearer's limb, pelvis, and/or torso without the use of a pocket, channel, stitching, additional fabric enclosure, anchor point, or other device, such that the fabric material at least partially surrounds at least a portion of the wearer's limb, pelvis, and/or torso.

Further, according to one aspect of this disclosure, it is not necessary to provide a safety clip to release any part of the apparatus 10 that could cause or create discomfort or an emergency to the user.

Further, according to another aspect of this disclosure, a clothing/apparel that maps one or more portions of the human body through the integration of fabrics and strategically-placed weighting and/or elastic resistance materials. In operation, the article can optimize exercise, training, rehabilitation, movement therapy, sport performance, human kinetic activities, conditioning, strengthening, endurance, balance, neuromuscular coordination, functional longevity, and improved activities of daily living, all while reducing the possibility of injury. The product is advantageously non-shifting, form-fitting, flexible, stretchable, breathable, and wicking. Weighting and/or elastic resistance elements may be infiltrated with relatively heavy particles or powder, for example, of minerals or metal, such as, but not limited to, tungsten. The integrated system may be strategically arranged to simulate the body's natural musculoskeletal system to provide a means to increase production of kinetic energy, through weighted and elastic resistance and/or improve the transmission and/or dissipation of kinetic energy during dynamic activity. Musculature can thereby be strengthened and conditioned for improved performance.

According to another aspect of this disclosure, an article of clothing or apparel is designed to map the body through the integration of fabrics and strategically-placed weighting and/or elastic resistance materials; the combination of which are designed to optimize conditioning, strengthening, endurance enhancement, training, performance, and functional longevity; and, all while reducing the possibility of injury. The specific body mapping, weighted, and elastic resistance article of clothing/apparel is non-shifting, form fitting, flexible, and stretchable. The article of clothing/apparel includes fabric substrate(s); fabric substrates integrated with medical grade silicone, rubber, and/or gel substance(s); and, fabric substrate(s) integrated with medical grade silicone, rubber, and/or gel substance(s) infiltrated with particles of, or powdered elements and/or minerals, such as, but not limited to, tungsten. The fabric(s), weighting, and elastic resistance are strategically arranged to resemble and simulate the body's natural musculoskeletal system. The specific fabric(s) and distributions of weight and/or elastic resistance material in the article of clothing/apparel are strategically located to provide the user with the ability to increase his/her production of kinetic energy, through weighted and elastic resistance, required by the user to successfully perform the skill/motion, thereby strengthening and conditioning the associated musculature performance without article of clothing/apparel, and/or to resist or terminate the release of the energy, as would naturally occur during any given body movement. This revolutionary system results from the combined effect of the strategically placed fabrics, with and/or without weighted and/or elastic resistance material, which are integrated into the article of clothing/apparel based upon the kinetic energy created, necessitated, and/or dissipated by a specific body movement(s). The overall system provides the unique ability to condition and train during the actual performance of the movement(s) required for the specific desired activity.

The above description illustrates preferred embodiments which achieve the objects, features and advantages of the present invention. The invention is defined by the following claims. The invention is not limited to the preferred embodiments. All modifications coming within the spirit and scope of the following claims are to be considered part of the present invention. What is claimed is:

The invention claimed is:

1. An apparatus, comprising:

at least one active portion and at least one inactive portion;

fabric material for at least partially surrounding at least a portion of a wearer's limb, pelvis, or torso, wherein the fabric material extends across an entirety of the active portion and an entirety of the inactive portion; and a plurality of resistance elements possessing weighted or elastic properties that are spaced apart from each other, and wherein the plurality of resistance elements are configured to form a pattern on the portion of the wearer's limb, pelvis, or torso, wherein the fabric material is integrated by the pattern in the active portion, and wherein the plurality of resistance elements are not located in the inactive portion, such that the inactive portion is more stretchable and foldable than the active portion; and wherein the plurality of resistance elements are integrated with the fabric material in the active portion, such that the plurality of resistance elements are configured to be located on the portion of the wearer's limb, pelvis, or torso, and such that the active portion is heavier than the inactive portion.

2. The apparatus of claim 1, wherein the inactive portion is configured to tightly cover a portion of a joint of the wearer's limb, pelvis, or torso.

3. The apparatus of claim 2, wherein the active portion fits snugly around at least the portion of the wearer's limb, pelvis, or torso.

4. The apparatus of claim 3, wherein the resistance elements are integrated with the fabric material such that the fabric material has varied stretchability.

5. The apparatus of claim 4, wherein the plurality of resistance elements include medical grade silicone.

6. The apparatus of claim 4, wherein the plurality of resistance elements include medical grade silicone, rubber, or gel imbedded with heavy material, including particulates or powder, in order to provide a weighted static amount of resistance to targeted musculature independent of movement.

7. The apparatus of claim 6, wherein the heavy material includes a mineral or a metal.

8. The apparatus of claim 4, wherein the solely elastic resistance elements are comprised of various stretchable, elastic fabrics or various fabric stitching methods thereby creating the elastic resistance in order to provide varying levels of resistance to targeted musculature dependent upon movement and degree of stretch.

9. The apparatus of claim 1, wherein the apparatus includes kinetic activity-related apparel.

10. An apparatus, comprising:

a shirt, pants, a sleeve, or leggings for snugly fitting one or more of a wearer's limbs;

at least one active portion and at least one inactive portion; and fabric material for at least partially surrounding at least a portion of the wearer's limbs, wherein the fabric material extends across an entirety of the active portion and an entirety of the inactive portion; and wherein the shirt, pants, sleeve, or leggings includes resistance elements possessing weighted and/or elastic properties that are spaced apart from each other, and wherein the resistance elements are configured to form a pattern on one of the wearer's limbs, wherein the fabric material is integrated by the pattern in the active portion, and wherein the resistance elements are not located in the inactive portion, such that the inactive portion is more stretchable and foldable than the active portion;

wherein the resistance elements are integrated with the fabric material in the active portion, such that the active portion is heavier than the inactive portion;

wherein the inactive portion is configured to tightly cover at least a portion of the wearer's limbs, and the active portion fits snugly around at least a portion of the wearer's limbs; and wherein the resistance elements are partially molded into the cloth, such that the active portion of the apparatus includes an integrated layer comprised of a weighted, elastomeric material molded into a superficial portion of the cloth while not necessitating a pocket, channel, stitching, additional fabric enclosure, anchor point, or other device for secure placement.

11. The apparatus of claim 10, wherein the resistance elements are various-sized, diamond-shaped, or another suitable shape.

12. The apparatus of claim 10, wherein the resistance elements are various-sized, circular, or another suitable shape.

13. The apparatus of claim 10, wherein the resistance elements are ovals, rectangles, triangles, squares, hexagons, or octagons.

14. The apparatus of claim 10, wherein the apparatus includes a plurality of inactive portions, and wherein the inactive portions contain portions wherein the fabric material is integrated with, and thereby made one with, elements based upon health, medical, or therapeutic requirements, and wherein the portions of the inactive portions are different from each other based upon the requirements.

15. The apparatus of claim 14, wherein the elements integrated into the inactive portions include silicone material.

16. The apparatus of claim 10, wherein the active and inactive portions define one or more crossing sections, and wherein the one or more crossing sections contain portions wherein the fabric material is integrated with, and thereby made one with, elements based upon health, medical, or therapeutic requirements, and wherein the portions of the crossing sections are different from each other based upon the requirements.

17. A method of putting on an article of motion-related clothing/apparel, comprising:

providing a shirt, pants, a sleeve, or leggings with (1) fabric material and (2) weighted or elastic resistance elements that are spaced apart from each other, and which form a pattern, wherein the fabric material is integrated by the pattern in an active portion, and wherein the resistance elements are not located in an inactive portion, such that the inactive portion is more stretchable and foldable than the active portion, and wherein the resistance elements are integrated with, and thereby made one with, the fabric material in the active portion, such that the active portion is heavier than the inactive portion;

stretching the fabric material between the resistance elements, such that the resistance elements move away from each other as a whole where fabric and the resistance elements are integrated as a one piece apparel; and subsequently, locating and securing the active portions, including a plurality of the weighted or elastic elements, and the inactive portions at desired locations on a wearer's limb without the use of a pocket, channel, stitching, additional fabric enclosure, anchor point, or other device, such that the fabric material and the plurality of the weighted or elastic elements at least partially surround at least a portion of the wearer's limb.

18. The method of claim 17, wherein the providing step includes providing a heavy material within the plurality of integrated resistance elements.

* * * * *